US007845400B2

(12) United States Patent
Smith, Jr. et al.

(10) Patent No.: US 7,845,400 B2
(45) Date of Patent: Dec. 7, 2010

(54) LAUNCHING TOOL FOR RELEASING CEMENT PLUGS DOWNHOLE

(75) Inventors: Sidney K. Smith, Jr., Conroe, TX (US); Donald G. Parmer, Jr., Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 355 days.

(21) Appl. No.: 12/020,973

(22) Filed: Jan. 28, 2008

(65) Prior Publication Data

US 2009/0188664 A1 Jul. 30, 2009

(51) Int. Cl.
*E21B 33/08* (2006.01)

(52) U.S. Cl. ..... 166/177.3; 166/177.4; 166/318; 166/373; 166/202

(58) Field of Classification Search ..... 166/373, 166/383, 202, 177.3, 70, 153, 242.6, 242.7, 166/177.4, 318
See application file for complete search history.

(56) References Cited

U.S. PATENT DOCUMENTS 3,915,226 A * 10/1975 Savage ..... 166/153
4,442,894 A 4/1984 Callihan et al.
4,809,776 A 3/1989 Bradley
5,052,488 A 10/1991 Fraser, III
5,522,458 A 6/1996 Watson et al.
5,553,667 A 9/1996 Budde et al.
5,615,741 A * 4/1997 Coronado ..... 166/387
5,722,491 A 3/1998 Sullaway et al.
5,743,335 A 4/1998 Bussear
5,762,139 A 6/1998 Sullaway et al.
5,787,979 A 8/1998 Giroux et al.
5,803,173 A 9/1998 Fraser, III et al.
5,813,457 A 9/1998 Giroux et al.
6,056,053 A 5/2000 Giroux et al.

(Continued)

FOREIGN PATENT DOCUMENTS

WO 9427026 A1 11/1994

OTHER PUBLICATIONS

Kudruyashov, Sergey, et al., "Well Productivity and Oil Recovery Enhancement in East and West Siberian Filelds as a Result of Inflow control Technology and Application", SPE 115486, Oct. 2008, 1-9.

(Continued)

*Primary Examiner*—William P Neuder
*Assistant Examiner*—Cathleen R Hutchins
(74) *Attorney, Agent, or Firm*—Steve Rosenblatt

(57) ABSTRACT

A wiper plug release tool uses a first pump down plug that lands in the tool to pressurize an internal chamber to slide a sleeve that undermines a set of dogs to allow the lower wiper plug to be decoupled from support. The shifting of this sleeve cams a second set of dogs into an internal passage in the tool to act as a landing location for a second pump down plug. Landing the second pump down plug on the now extended dogs allows a net pressure to be applied to an upper piston which shifts a sleeve to release the support for the second wiper plug. The upper piston remains in pressure balance unless the second pump down plug can be landed on the dogs that only extended because the sleeve that released the lower wiper plug had shifted.

17 Claims, 13 Drawing Sheets

U.S. PATENT DOCUMENTS

| | | | |
|---|---|---|---|
| 6,082,451 | A | 7/2000 | Giroux et al. |
| 6,196,311 | B1 | 3/2001 | Treece |
| 6,206,094 | B1 | 3/2001 | Smith, Jr. |
| 6,513,590 | B2 | 2/2003 | Allamon et al. |
| 6,527,057 | B2 | 3/2003 | Fraser, III et al. |
| 6,571,880 | B1 | 6/2003 | Butterfield, Jr. et al. |
| 6,575,238 | B1 | 6/2003 | Yokley |
| 6,595,282 | B2 | 7/2003 | Smith, Jr. |
| 6,672,384 | B2 | 1/2004 | Pedersen et al. |
| 6,681,860 | B1 | 1/2004 | Yokley et al. |
| 6,698,513 | B1 | 3/2004 | Yokley |
| 6,712,152 | B1 | 3/2004 | Yokley et al. |
| 6,799,638 | B2 | 10/2004 | Butterfield, Jr. |
| 6,802,372 | B2 | 10/2004 | Budde |
| 7,055,611 | B2 | 6/2006 | Pedersen et al. |
| 7,143,831 | B2 | 12/2006 | Budde |
| 2008/0093080 | A1 * | 4/2008 | Palmer et al. ..... 166/318 |

OTHER PUBLICATIONS

Park, Jonathan, et al., "Development of Low Risk, High Level TAML Level 5 Multilaterals in the South China Sea", SPE 88542, Oct. 2004, 1-5.

Hogg, C., "Identifying the Economic Savings Beyond the Reservoir", SPE 94677, Apr. 2005, 1-6.

* cited by examiner

LAUNCHING TOOL FOR RELEASING CEMENT PLUGS DOWNHOLE

FIELD OF THE INVENTION

The field of this invention is wiper plug dropping tools and more particularly those that can sequentially launch wiper plugs using pump down plugs that are retained in the tool.

BACKGROUND OF THE INVENTION

In cementing casing or liner, wiper plugs are used to isolate the delivered cement from existing well fluids and to drive any leftover cement out of the casing or liner and through the cement shoe, which is a one way valve at the lower end of the casing or liner string. Some systems get by with only a single wiper plug. In those systems the cement is delivered on top of existing well fluids with no barrier. After the cement is delivered, the one wiper plug is dropped to displace the cement from the casing or liner and into the surrounding annulus. After that the cement shoe at the bottom of the string along with the wiper plug are simply milled up and the well is continued deeper.

In two wiper plug systems of the past, one of the concerns was to only drop one wiper plug at a time. Earlier designs of multi-plug systems used a system of two shear pins. The lower pin supported the lower wiper plug from the wiper plug above it. The upper pin held the upper plug to the tool body and was designed to shear at a higher pressure than the lower shear pin. A pump down plug seated in the tool to allow pressure to break the lower shear pin while claiming to keep the upper wiper plug in pressure balance. What was supposed to happen is that the lower pin sheared and the lower wiper plug launched. Then another pump down plug was landed to allow a net pressure force to be applied to the remaining wiper plug so that the upper shear pin that was rated higher than the lower shear pin could release. The upper wiper plug then was launched. This design is illustrated in Application WO 94/27026. The problem with this design is that if the lower shear pin didn't release when needed, pressure would build to the point of breaking the higher set upper shear pin and both wiper plugs would launch together. In other words, there was nothing to assure the upper wiper plug could not be launched with the lower wiper plug.

In an effort to address this issue U.S. Pat. No. 6,206,094 was designed to use a hydraulic system with metering capability to advance the lower wiper plug while it was still retained to the tool for a given travel distance at which point the lower wiper plug could launch. A first pump down plug allowed pressure to be applied to move a piston that moved the wiper plug at a controlled rate until it extended far enough from the tool housing to be released. A second pump down plug then allowed another piston to move at a regulated rate to advance the second wiper plug beyond the housing far enough so that it too could be launched. While this tool provided greater assurance of launching only one wiper plug at a time, it was complicated and involved rupture discs and hydraulic flow through metering orifices. It presented some risk for smooth operation as intended.

Other known wiper plug launching systems were the LFC Four Plug System offered by Baker Oil Tools that worked similarly to Application WO 94/27026 but used collets which became unsupported or sheared to trigger a release in conjunction with shear pins to hold a sleeve from moving where a collet became unsupported for release. Another similar design is U.S. Pat. No. 5,553,667 (FIG. 9). Other designs in this area include U.S. Pat. Nos. 5,803,173; 6,712,152; 6,698,513; 6,575,238; 6,681,860; 6,672,384 and 7,055,611.

What is needed and provided by the present invention is a wiper plug dropping tool that retains the pump down plugs and ensures the orderly release of the wiper plugs. It features a sleeve that is moved to release the lower wiper plug whose movement makes it possible to actually land another pump down plug in a proper position so that the release mechanism for the upper wiper plug can be actuated. Without movement of the release sleeve for the lower wiper plug there is no release of the upper wiper plug. These and other features of the present invention will be more readily apparent to those skilled in the art from a review of the description of the preferred embodiment and the associated drawings with the understanding that the full scope of the invention is measured by the claims that appear below.

SUMMARY OF THE INVENTION

A wiper plug release tool uses a first pump down plug that lands in the tool to pressurize an internal chamber to slide a sleeve that undermines a set of dogs to allow the lower wiper plug to be decoupled from support. The shifting of this sleeve cams a second set of dogs into an internal passage in the tool to act as a landing location for a second pump down plug. Landing the second pump down plug on the now extended dogs allows a net pressure to be applied to an upper piston which shifts a sleeve to release the support for the second wiper plug. The upper piston remains in pressure balance unless the second pump down plug can be landed on the dogs that only extended because the sleeve that released the lower wiper plug had shifted.

DETAILED DESCRIPTION OF THE PREFERRED EMBODIMENT

Figure 1A:
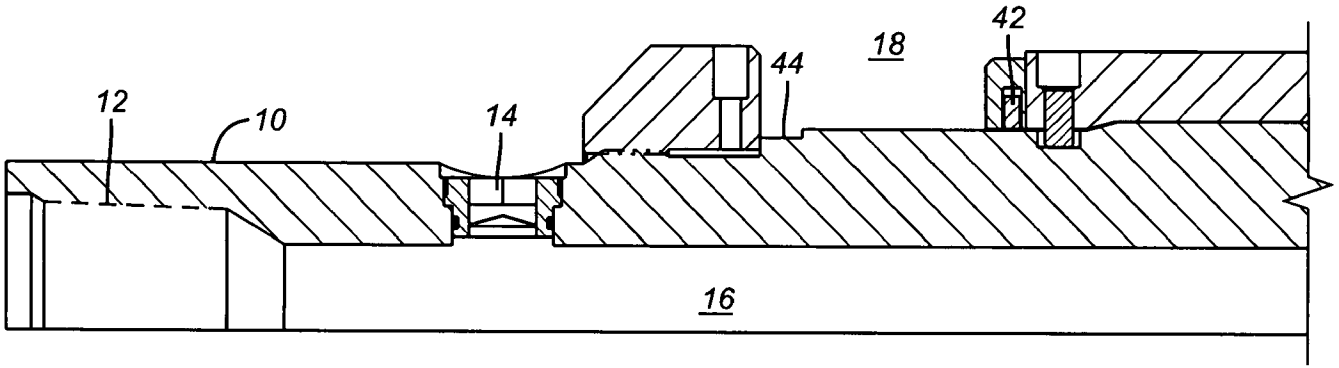
FIGS. 1*a*-1*d* show a half section of the tool in the run in position.
Figure 1B:
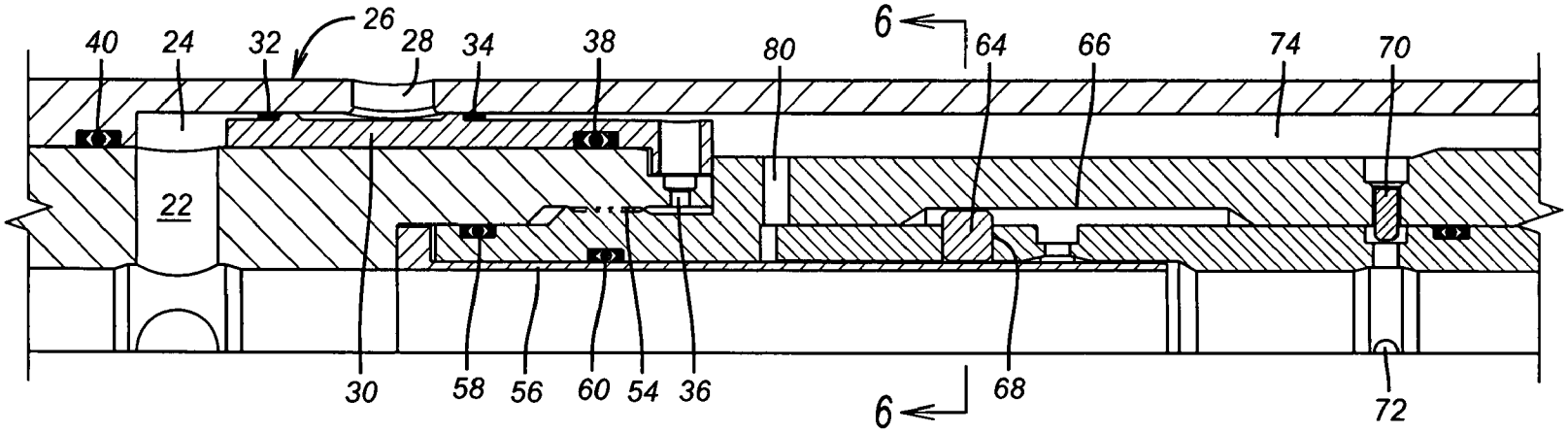

Referring to FIG. 1*a* upper mandrel 10 has a thread 12 for connecting a string, not shown. A rupture disc 14 allows diversion of pressure from internal passage 16 to the annulus 18, for an emergency procedure that will be described below. The surrounding casing or liner that defines the annulus 18 is not shown except as 20 in FIG. 7, which is at the lower portion of the string to be cemented and generally close to a cementing shoe (not shown).

A port 22 leads from passage 16 into chamber 24 that is defined by outer sleeve 26. Port 28 is offset from port 22 and is isolated by sleeve 30 and its seals 32 and 34. Sleeve 30 is secured between upper mandrel 10 and lower mandrel 52. Seal 38 spans the gap between upper mandrel 10 and sleeve 30. Seal 40 seals between mandrel 10 and sleeve 26 on the other side of port 22 so that when pressure is applied through passage 22 with passage 16 obstructed, as will be explained below, pressure builds up in chamber 24 to put uphole pressure on sleeve 26. Sleeve 26 carries a snap ring 42 that is designed to snap into surface 44 after uphole movement of sleeve 26. The snapped in position is shown if FIG. 5*a*. Concluding the description of the sleeve 26 a lower segment 46 attached at thread 48 and having a lower end 50 with an internal recess 51.

Continuing now with the upper mandrel 10, a lower mandrel 52 is attached at thread 54 trapping a sleeve 56 in between. Seals 58 and 60 mounted to lower mandrel 52 maintain the integrity of passage 16. Lower launch sleeve 62 is pinned to lower mandrel 52 by pins 70. Dogs 64 are initially trapped in recess 66 in lower mandrel 52 by sleeve 56. Dogs 64 extend through openings 68 in lower mandrel 52. A shear pin or pins 70 retain lower launch sleeve 62 to lower mandrel 52. Circumferentially offset from pins 70 are passages 72 that lead from passage 16 to chamber 74. Seals 76 and 78 seal off the lower end of chamber 74. Passage 80 leads from chamber 74 to passage 16 around sleeve 56.

Figure 4B:
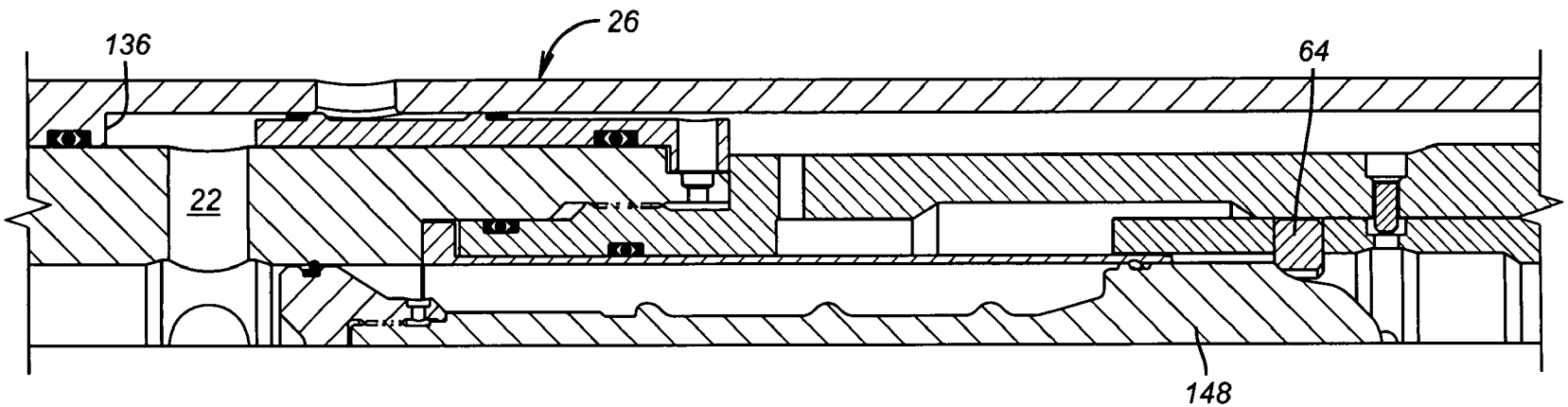
Figure 4C:
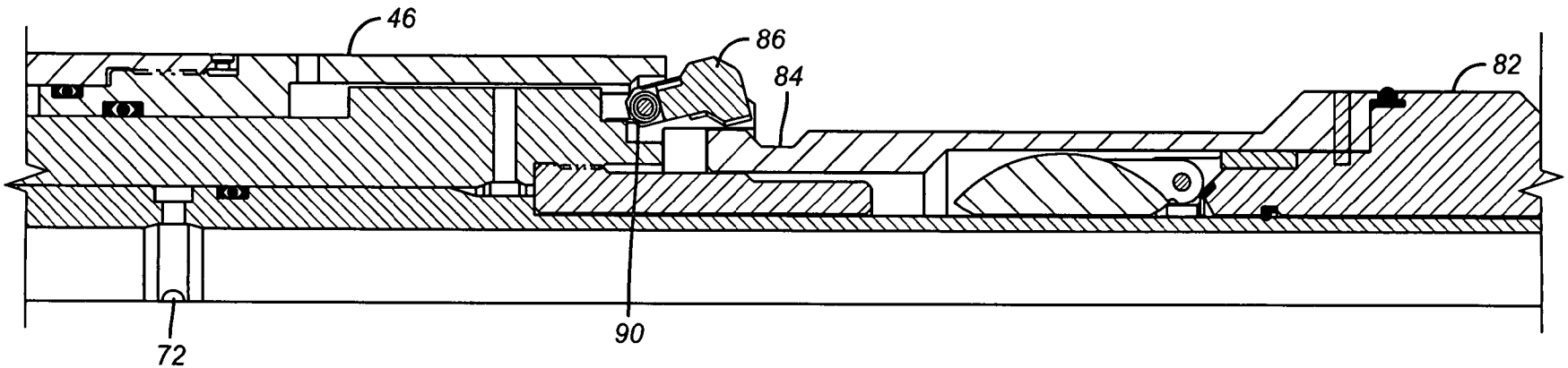

Upper wiper plug 82 has a recess 84 into which are trapped dogs 86 that pivot at 88 and have a torsion spring 90 to bias them radially inwardly when sleeves 26 and 46 move up as shown in FIG. 4*c*. Upper wiper plug 82 has external fins 92 and an internal bore 94 that allows it to be mounted over lower launch sleeve 62. A flapper 96 is designed to close the bore 94 after the upper wiper plug is launched.

Figure 2A:
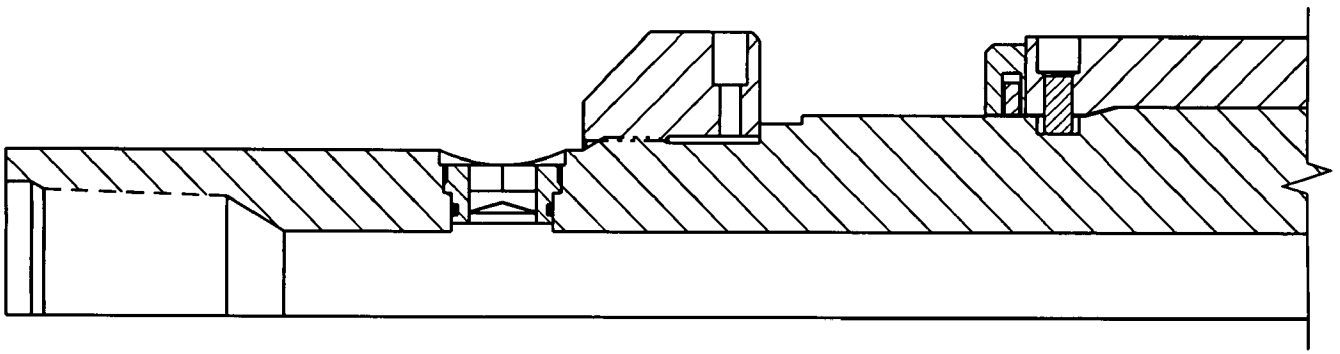
FIGS. 2*a*-2*d* show the tool of FIGS. 1*a*-1*d* with the first pump down plug landed.
Figure 2B:
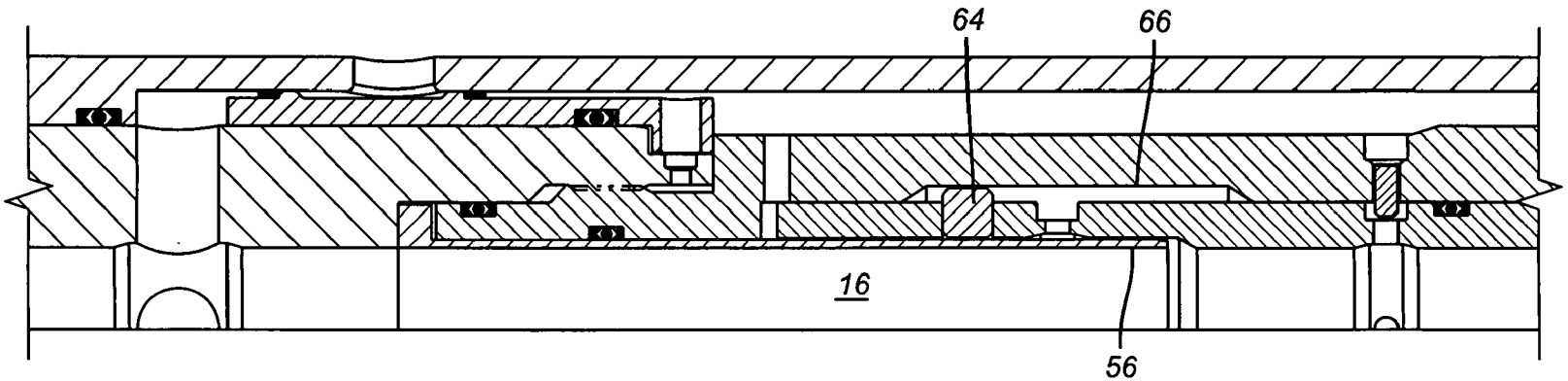
Figure 1C:
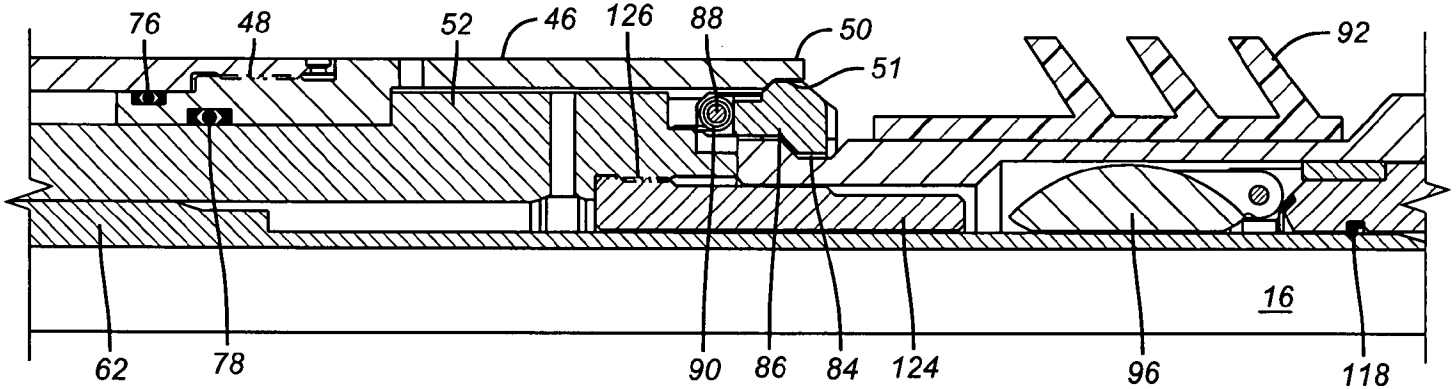
Figure 2C:
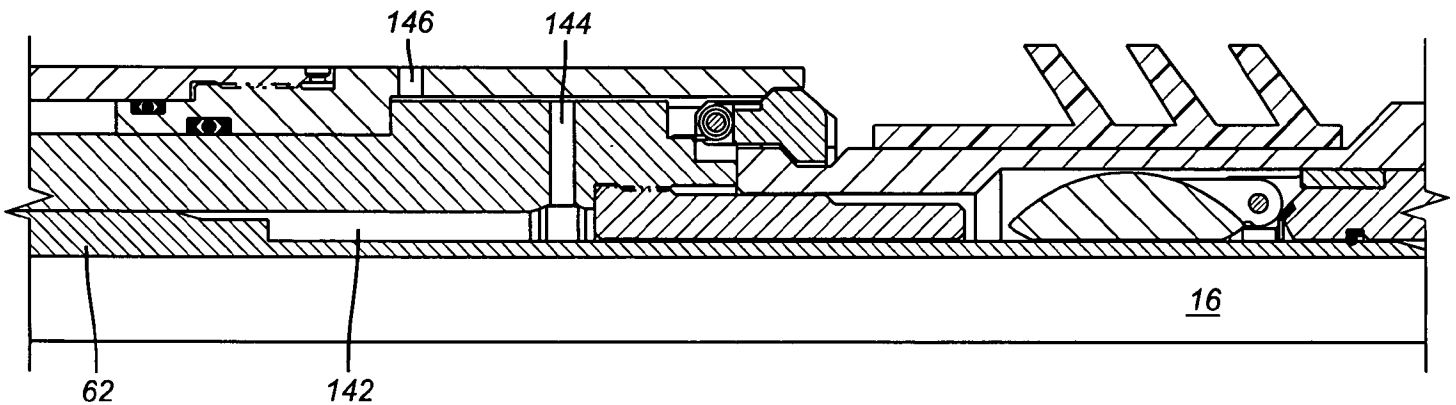
Figure 1D:
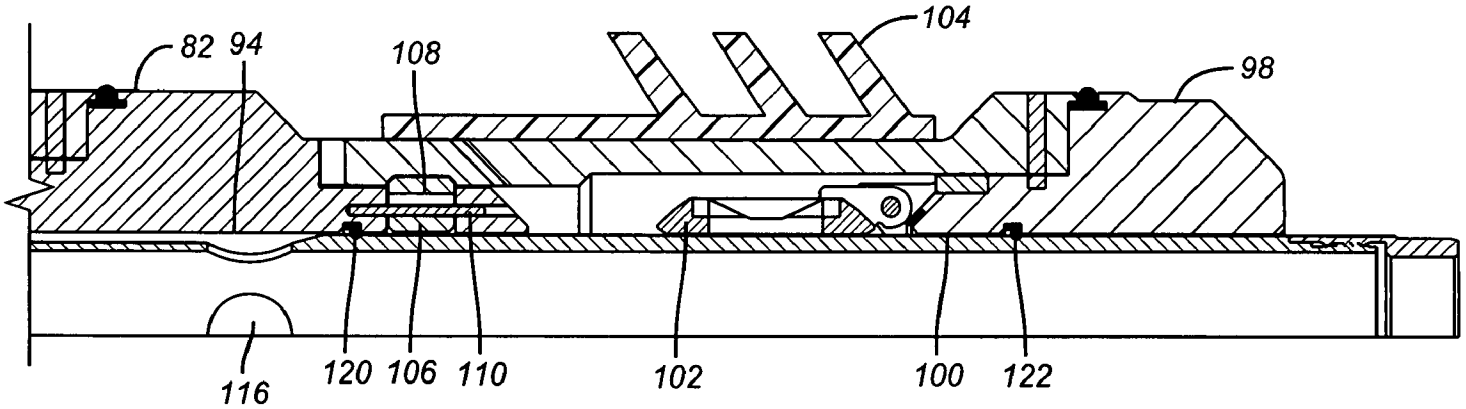

Lower wiper plug 98 is similar to upper plug 82 in that it has a bore 100 that allows it to be mounted over lower launch sleeve 62 and a flapper 102 that closes bore 100 after launch of lower wiper plug 98. External fins 104 aid in propelling the plug 98 downhole. Lock dogs 106 have a bore 108 and a pin 110 extending though it to retain them to upper wiper plug 82. In the FIG. 1*c* position, the dogs 106 are trapped into recess 112 so as to support the lower wiper plug 98 off of the upper wiper plug 82. Lower launch sleeve 62 has a recessed surface 114 that in FIGS. 1*c* and 2*c* is offset from dogs 106. A port 116 that will ultimately be used to flow cement is initially held closed by seals 118 and 120 on upper wiper plug 82. Seal 122 on lower wiper plug 98 seals against launch sleeve 62 to allow pressure in annulus 18 to be used to propel the plug 98 after dogs 106 are undermined. Finally, sleeve 124 shown in FIG. 1*c* supports upper wiper plug 82 against dogs 86 that are in turn held in recess 84 by lower segment 46. If the running tool fails to function and release the liner wiper plugs, rupture disk 14 may be burst with applied internal pressure to serve as an emergency bypass for flow around the tool.

Figure 2D:
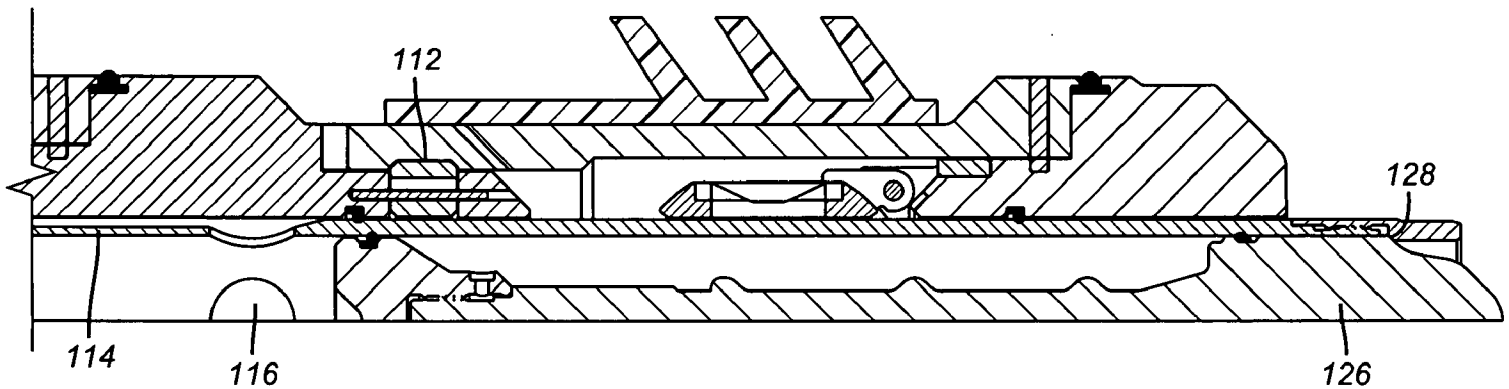
Figure 3A:
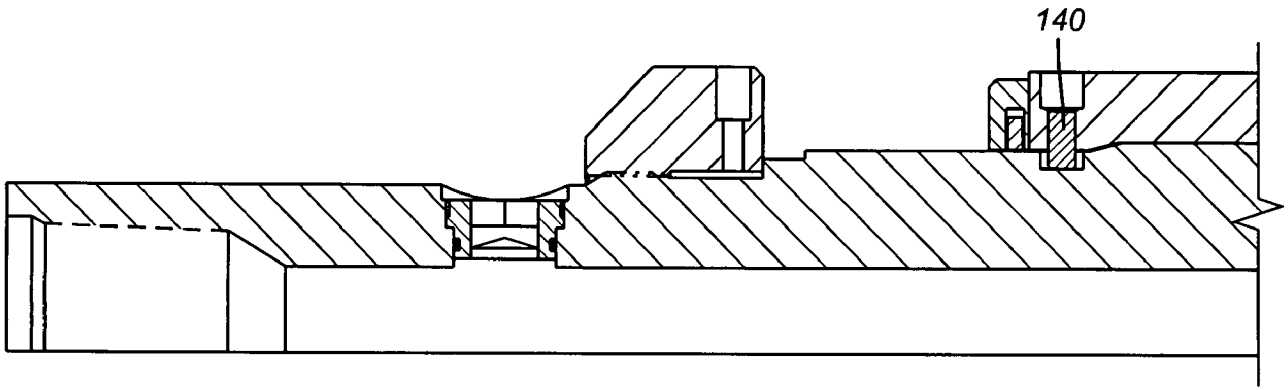
FIGS. 3*a*-3*d* show the tool of FIGS. 2*a*-2*d* with lower wiper plug released.
Figure 4A:
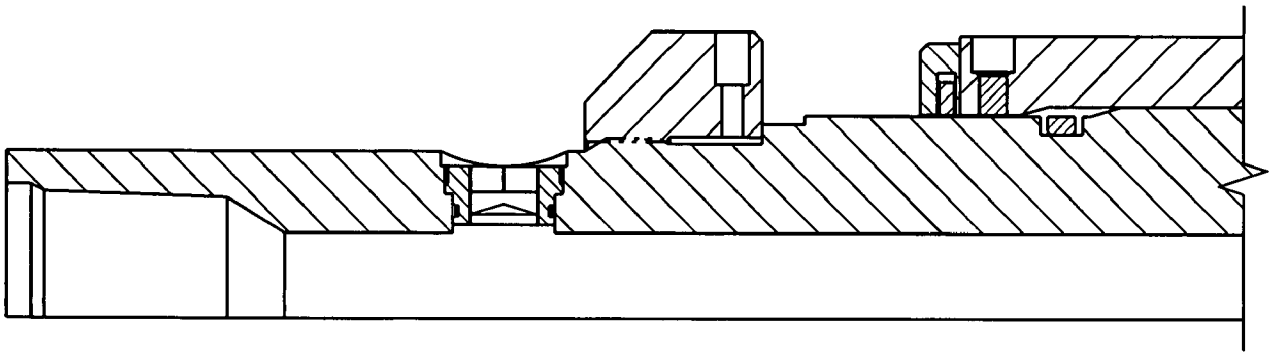
FIGS. 4*a*-4*d* show the tool of FIGS. 3*a*-3*d* with the second pump down plug landed and the upper wiper plug released to drop.
Figure 3B:
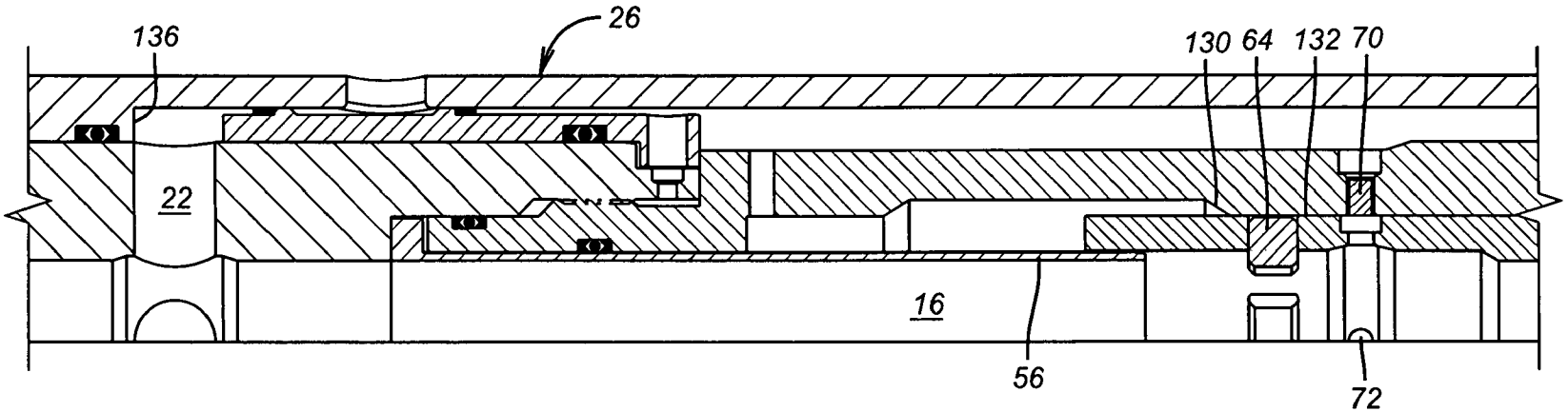
Figure 3C:
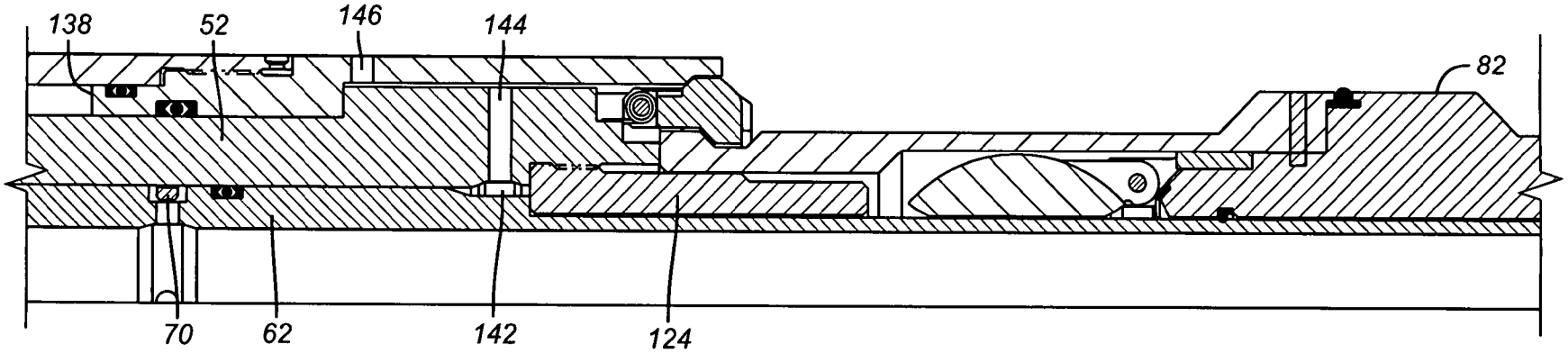
Figure 3D:
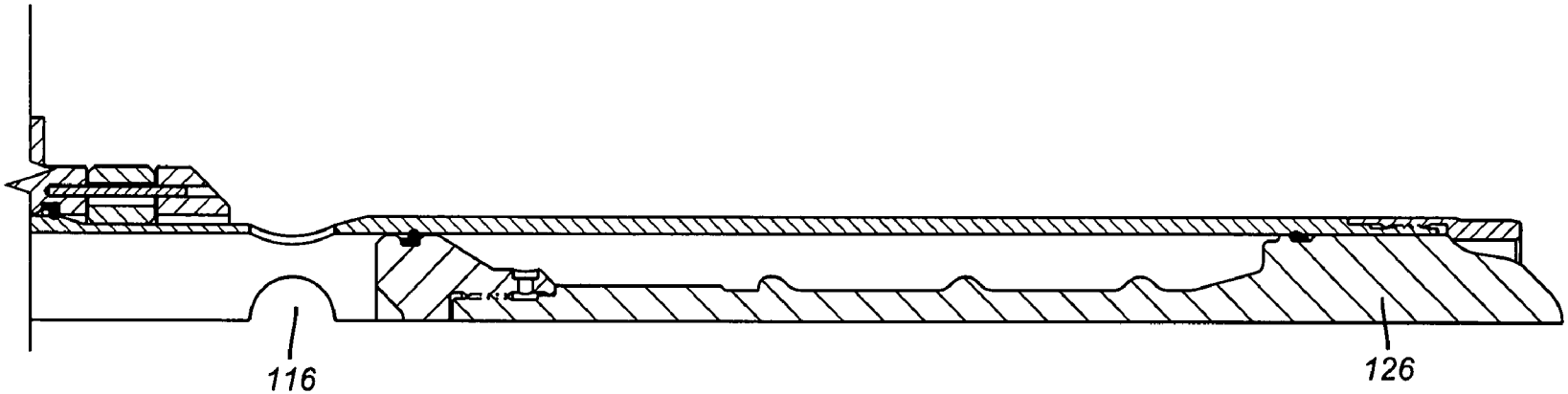
Figure 4D:
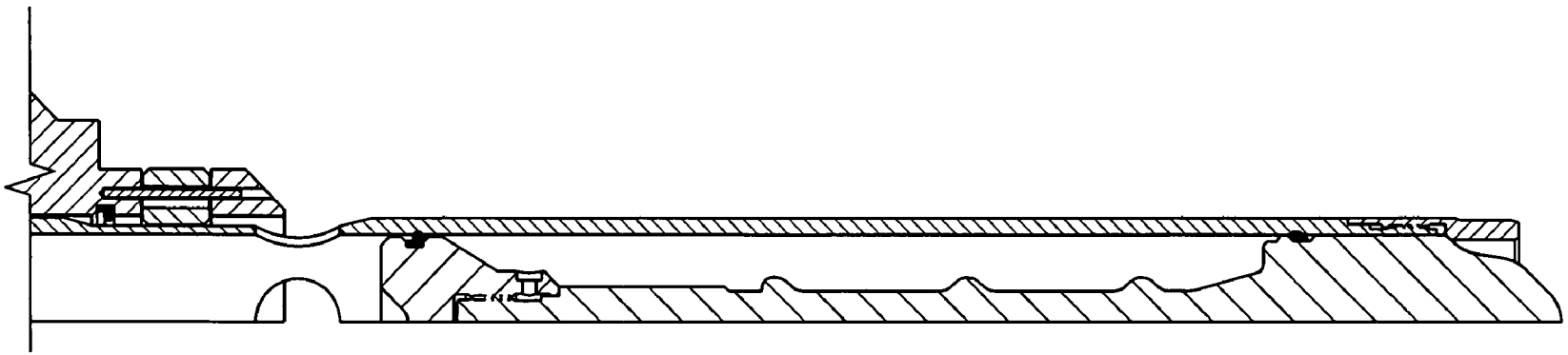

The major components now having been described, the operation of the tool will now be reviewed in detail. As shown in FIG. 2*d* a first pump down plug 126 having a known design lands on shoulder 128 on lower launch sleeve 62 thus blocking the passage 16. Port 116 is isolated by seals 118 and 120 at this time. As pressure is built up the first thing to happen is to break the shear pins 70 shown in two pieces in FIGS. 3*b*-3*c*. Launch sleeve 62 is able to move down after shear pins 70 are broken until shouldering on ring 124. The downward movement of lower launch sleeve 62 allows dogs 64 in windows 68 to slide in elongated recess 66 which cams dogs 64 onto surface 130 so that they the move radially inwardly, having already cleared the lower end of sleeve 56 and now supports the dogs 64 in a position where they extend into passage 16 as seen by comparing FIGS. 2*b* and 3*b*. At the same time, as shown in FIGS. 3*c*-3*d*, the shifting of the lower launch sleeve 62 has placed recess 114 opposite dogs 106 to let them come out of lower wiper plug 98 so that it is launched and the port 116 is exposed for pumping cement behind the launched lower wiper plug 98. As the lower wiper plug 98 leaves the lower launch sleeve 62 the flapper 102 is able to close so that the cement can then drive the plug 98 until it bumps surface 134 in the landing collar that is part of the casing or liner 20. After bursting the rupture disk in flapper 102, the cement continues through the landed plug and into the annulus around the casing or liner 20 in a known manner.

While the wiper plug 98 is being launched, the sleeve 26 is in pressure balance and can't move. This is because pressure in passage 16 of the tool communicates to port 22 to act on surface 136 to put an uphole force on upper sleeve 26, see FIG. 3*b*. At the same time pressure in passage 16 communicates through ports 72 and 80 to surface 138 in cavity 74 that is sealed at seals 76 and 78. The surface 138 has the same cross-sectional area as surface 136 so that there can be no net force applied to move sleeve 26, which is initially pinned to the upper mandrel 10 with pin or pins 140. It is worth repeating that dogs 64 remain retracted until pump down plug 126 passes and pressure buildup causes the lower launch sleeve 62 to shift camming the dogs 64 into passage 16 when only then can they be used to catch the next pump down plug 148 as shown in FIG. 4*b*.

Note that as lower launch sleeve 62 moves down it displaces fluid from cavity 142 through passages 144 and 146 as the volume of cavity 142 decreases until the lower launch sleeve's movement is stopped by hitting sleeve 124 as shown in FIG. 3*c*. At this point the cement port 116 is exposed to pass cement.

Figure 5A:
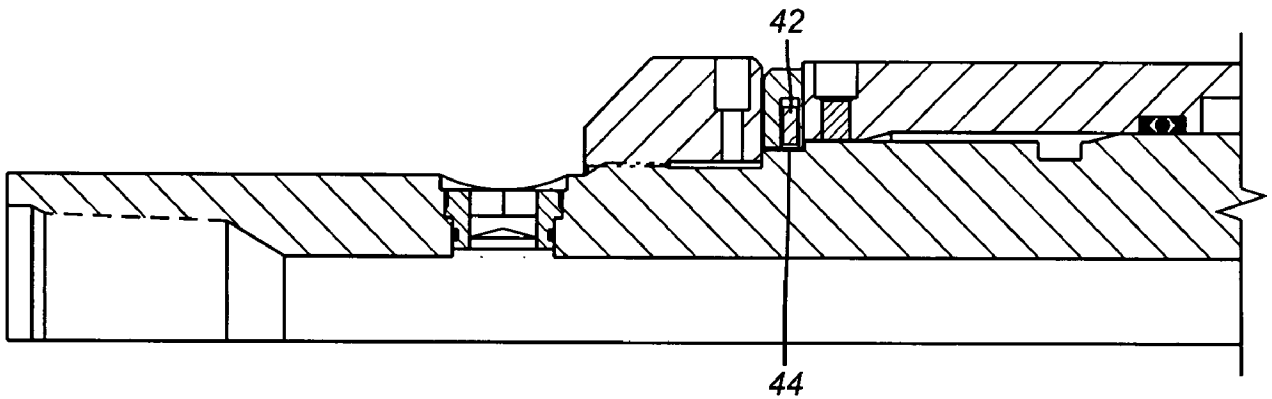
FIGS. 5*a*-5*d* show the tool of FIGS. 4*a*-4*d* with the upper release sleeve locked into the released position.
Figure 5B:
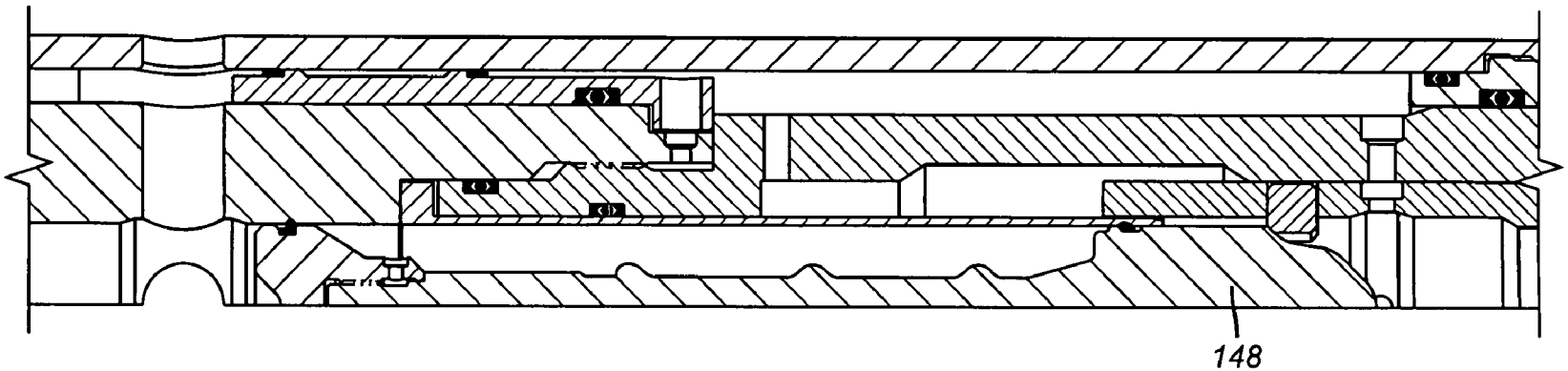
Figure 5C:
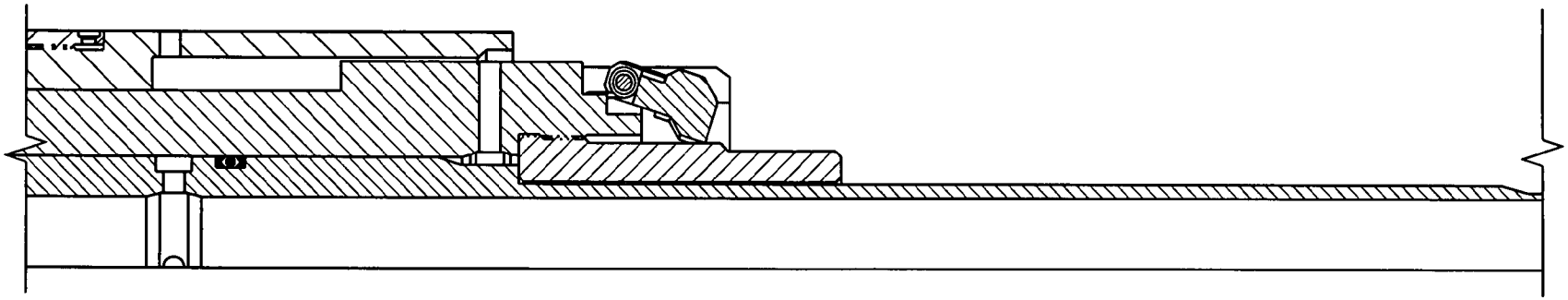
Figure 5D:
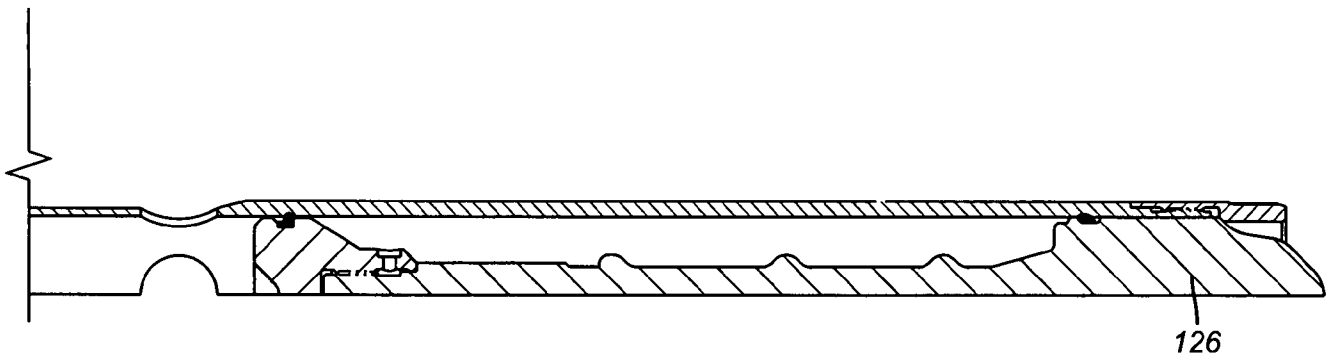
Figure 6:
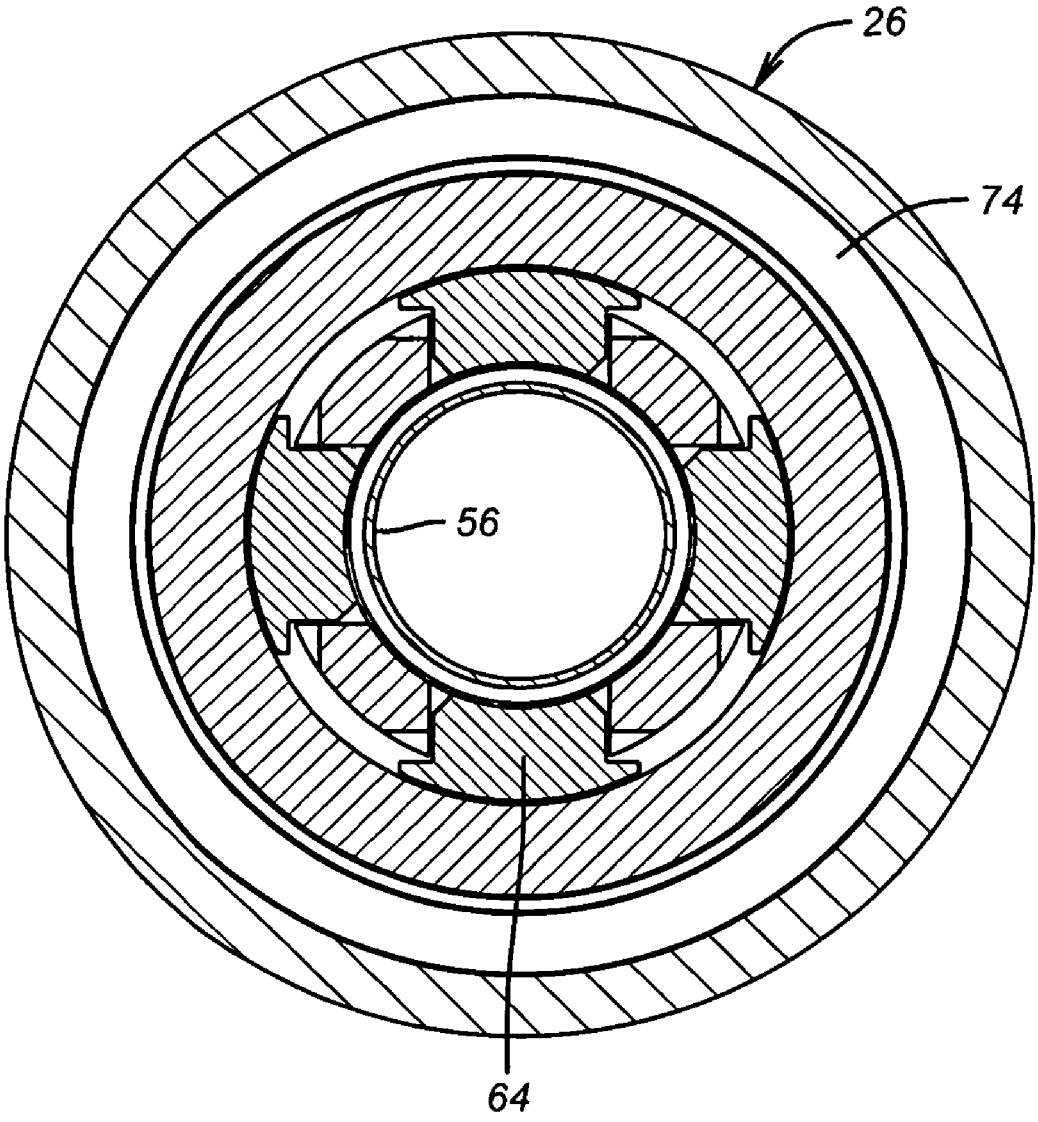
FIG. 6 is the view along lines 6-6 of FIG. 1*b*.
Figure 7A:
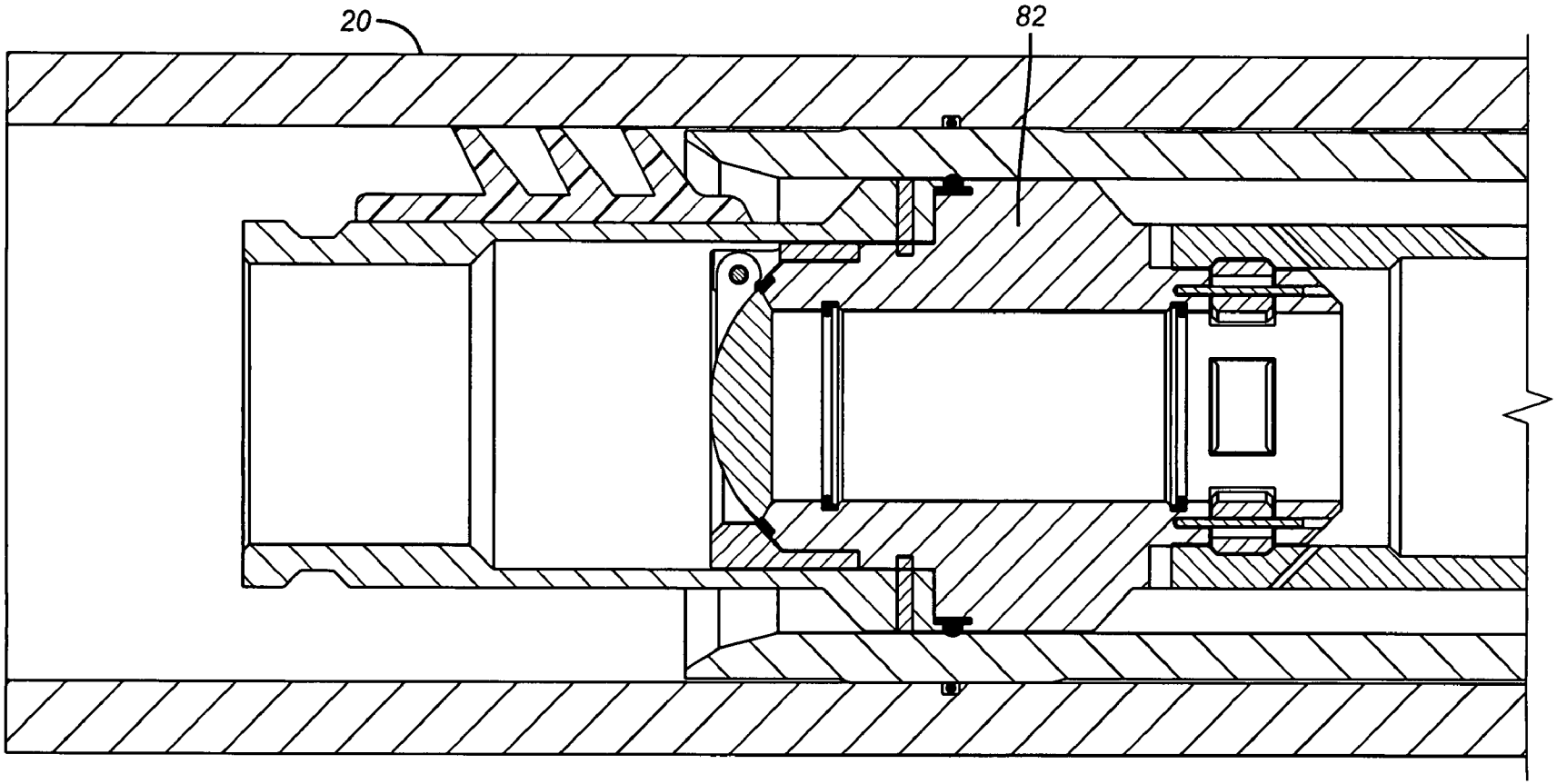
FIGS. 7*a*-7*b* show both launched wiper plugs captured in a landing collar downhole.
Figure 7B:
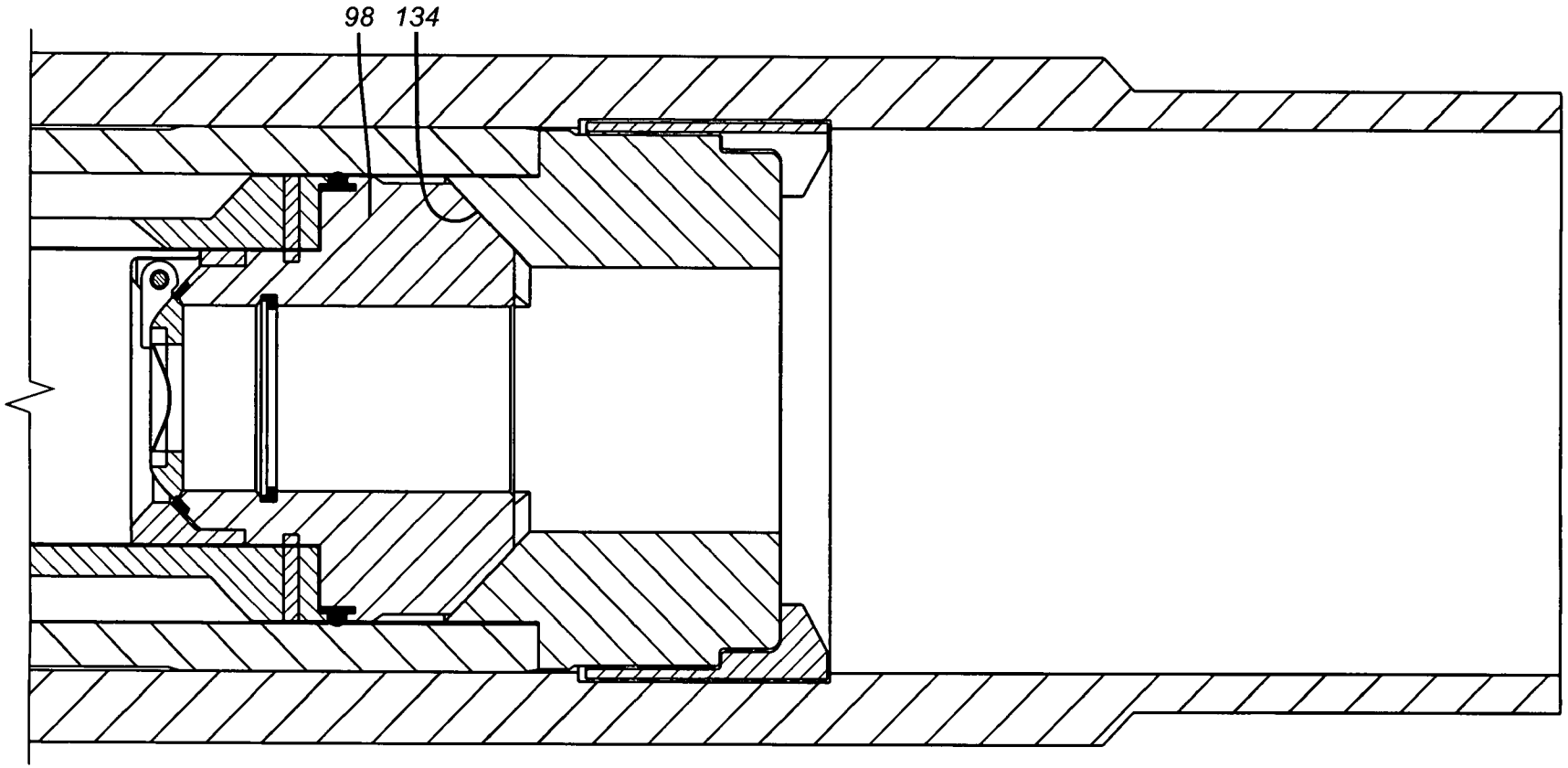

When the second pump down plug 148 lands on dogs 64 the ports 72 and 80 are isolated and pressure applied to passage 16 is now exclusively directed to ports 22. An unopposed uphole force is now applied to surface 136 to shear pins 140. As upper sleeve 26 moves up, its lower end 46 no longer covers dogs 86 putting the upper wiper plug in position for release as shown in FIG. 4*c*. The upward movement of sleeves 26 and 46 is locked in as snap ring 42 contracts against surface 44 as shown in FIG. 5*a*. Applied pressure above the wiper plug fins propels the released wiper plug 82 down the casing or liner 20 until it bumps lower wiper plug 98 as shown in FIG. 7*a*. The entire tool with retained pump down plugs 126 and 148 can be removed as an assembly from the well.

Those skilled in the art will now appreciate that the apparatus described above prevents the inadvertent release of two wiper plugs because not only is the upper plug release mechanism in pressure balance when the lower plug is released but the dogs 64 that allow the use of pump down plug 148 to ultimately overcome that pressure balanced configuration are held retracted making them inaccessible to the initial pump down plug 126 as it travels past to its position shown in FIG. 2*d*. There is no way to accidentally release the upper wiper plug 82 before the lower plug 98 is released. In prior designs, such as FIG. 9 of U.S. Pat. No. 5,553,667 the release mechanism for the upper plug is exposed and the lower pump down plug has to travel through it where it can get lodged and result in launching both plugs. Even though the first pump down plug in that prior design is made smaller to fit through the release mechanism of the upper plug the possibility exists that the wrong shear device will fail first and release both wiper plugs. In the present invention, not only is the release mechanism in pressure balance from pressure buildup in passage 16 with pump down plug 126 landed but the movement of the first pump down plug to its landing shoulder 128 while there is no higher shoulder for that pump down plug 126 to land on that would in any way allow an unbalanced pressure force to be applied to the upper release sleeve 26.

The above description is illustrative of the preferred embodiment and many modifications may be made by those skilled in the art without departing from the invention whose scope is to be determined from the literal and equivalent scope of the claims below.

We claim:

1. An apparatus for sequentially launching wiper plugs into a wellbore, comprising:

a mandrel having a passage therein;

an upper and a lower wiper plug releasably mounted to said mandrel using an upper movable release assembly and a lower movable release assembly respectively associated therewith;

a first plug and second plugs to sequentially engage said lower and upper movable release assemblies for sequential release of said lower wiper plug and then said upper wiper plug;

a retracted landing shoulder for said second plug that is disposed outside said passage at a location where said retracted landing shoulder selectively cannot directly support said second plug until after said first plug has passed said retracted shoulder and engaged said lower movable release assembly.

2. The apparatus of claim 1, wherein:

said lower release assembly moves with said first plug to extend said retracted landing shoulder into said passage.

3. The apparatus of claim 2, wherein:

said retracted landing shoulder is moved in tandem with said lower release assembly until said retracted landing shoulder extends beyond a protective sleeve.

4. The apparatus of claim 3, wherein:

said mandrel cams said landing shoulder into said passage after said landing shoulder clears said protective sleeve.

5. The apparatus of claim 4, wherein:

said landing shoulder comprises at least one dog.

6. The apparatus of claim 1, wherein:

said lower wiper plug is selectively supported by said upper wiper plug.

7. The apparatus of claim 6, wherein:

said lower movable release assembly comprises a lower sleeve that in a first position holds said lower wiper plug to said upper wiper plug and when shifted to a second position, with said first plug landed in said lower sleeve, releases said lower wiper plug from said upper wiper plug.

8. The apparatus of claim 7, wherein:

said lower sleeve retains a dog that extends through said lower and upper wiper plugs in said first position and that undermines said dog in said second position to allow said lower wiper plug to release from said upper wiper plug.

9. The apparatus of claim 1, wherein:

said upper movable release assembly is in pressure balance from applied pressure in said passage with said first plug engaged to said lower movable release assembly.

10. The apparatus of claim 9, wherein:

said upper movable release assembly can only receive an unbalanced pressure force from said passage with said retracted landing shoulder extended and said second plug landed on it.

11. The apparatus of claim 1, wherein:

said upper movable release assembly is disposed outside said passage.

12. The apparatus of claim 1, wherein:

said upper movable release assembly comprises an upper sleeve that selectively retains at least one retaining dog to said upper wiper plug.

13. The apparatus of claim 12, wherein:

said retaining dog is pivotally mounted;

said upper sleeve is actuated with pressure from said passage when said second plug is disposed in said passage.

14. The apparatus of claim 13, wherein:

said retaining dog is biased to release said upper wiper plug when said upper sleeve is retracted away from said retaining dog.

15. The apparatus of claim 14, wherein:

said upper sleeve is fixed to said mandrel after being moved away from said retaining dog.

16. The apparatus of claim 1, wherein:

said passage further comprises a rupture disc to allow flow from said passage to exit said mandrel and bypass said wiper plugs in case of malfunction.

17. The apparatus of claim 1, wherein:

said wiper plugs each comprise a bore with a flapper in the open position when mounted to said mandrel;

said flapper closing said bore when said plugs fall clear of said mandrel.

* * * * *